US007318755B2

(12) United States Patent
Sauer

(10) Patent No.: US 7,318,755 B2
(45) Date of Patent: Jan. 15, 2008

(54) PLUG-IN CONNECTION DEVICE

(75) Inventor: Dieter Sauer, Heddesbach (DE)

(73) Assignee: Cooper Crouse-Hinds GmbH, Soest (DE)

( * ) Notice: Subject to any disclaimer, the term of this patent is extended or adjusted under 35 U.S.C. 154(b) by 79 days.

(21) Appl. No.: 10/538,775

(22) PCT Filed: Aug. 28, 2003

(86) PCT No.: PCT/EP03/09555

§ 371 (c)(1),
(2), (4) Date: Jan. 4, 2006

(87) PCT Pub. No.: WO2004/054044

PCT Pub. Date: Jun. 24, 2004

(65) Prior Publication Data

US 2006/0141842 A1 Jun. 29, 2006

(30) Foreign Application Priority Data

Dec. 10, 2002 (DE) ..... 202 19 125 U

(51) Int. Cl.
*H01R 13/64* (2006.01)

(52) U.S. Cl. ..... 439/680; 439/607

(58) Field of Classification Search ..... 439/587, 439/589, 607, 610, 680, 681, 903, 936
See application file for complete search history.

(56) References Cited

U.S. PATENT DOCUMENTS

| | | | | |
|---|---|---|---|---|
| 3,402,382 | A * | 9/1968 | De Tar | 439/469 |
| 3,576,517 | A * | 4/1971 | Johnson et al. | 439/274 |
| 3,850,495 | A * | 11/1974 | Glover | 439/273 |
| 4,193,655 | A * | 3/1980 | Herrmann, Jr. | 439/166 |
| 5,439,386 | A * | 8/1995 | Ellis et al. | 439/322 |

FOREIGN PATENT DOCUMENTS

| | | |
|---|---|---|
| DE | 37 44 088 | 7/1989 |
| GB | 1 059 067 | 2/1967 |
| GB | 2 356 743 | 5/2001 |

OTHER PUBLICATIONS

International Search Report for International Application No. PCT/EP2003/009555; 2 pages; dated Jan. 28, 2004.

* cited by examiner

*Primary Examiner*—Thanh-Tam Le
(74) *Attorney, Agent, or Firm*—Fish & Richardson P.C.

(57) ABSTRACT

The plug-in connection device consists of at least one plug part and one socket part, which can be connected together detachably. A plug insert or socket insert is accommodated in the respective part, wherein at least one of the inserts is configured for plug coding. Each insert exhibits electrical connecting devices which cannot be rotated relative to it. It can be inserted into the assigned part, rotationally fixed, in a number of rotational positions relative to it.

20 Claims, 2 Drawing Sheets

PLUG-IN CONNECTION DEVICE

FIELD OF THE INVENTION

The invention relates to a plug-in connection device consisting of at least one plug part and a socket part which are detachably connected to each other and a plug or socket insert accommodated in the respective part, wherein at least one of the inserts is configured for the plug coding.

BACKGROUND OF THE INVENTION

Such a plug-in connection device is known from DE 299 15 263 U1. With the known plug-in connection device it comprises a plug and a socket. A socket insert is arranged, supported for rotation, between a switched-off position and a switched-on position within the socket housing. The said insert can be rotated between its positions by a plug inserted in the socket. Furthermore, in the socket insert a latching device is provided which is supported for adjustment between a blocking position and a release position. This latching device exhibits at least one coding projection which, with an inserted plug, can fit in a corresponding coding recess on the plug.

Furthermore, such a plug-in connection device of the aforementioned type is known from DE 200 21 374 U1. With this known plug-in connection device a socket insert is also supported for rotation between a switched-off and a switched-on position in a socket housing. A pin-shaped latching device is supported for adjustment between a pressed-in blocking position and a release position protruding from the socket insert. The socket insert can only be rotated between the switched-off and switched-on positions when the latching device is in the release position. The pin-shaped latching device is here formed from a removable latching part and a blocking part which are arranged one above the other in the socket insert.

Both known plug-in connection devices have been well-proven in practice and exhibit a reliable plug coding in order to be able to actually only connect together the assigned plug parts and socket parts in such a way so that then an electrical connection is established.

However, the design of the known plug-in connection devices is relatively complicated, because a large number of parts are provided for the plug coding in addition to the actual parts for the plug-in connection device. At the same time because of this, relatively high costs arise for such a plug-in connection device. Due to the large number of additional parts and their movement within the plug part or socket part, there is also the possibility that one of the parts is restricted in its possible movement on account of wear, damage, dirt, etc. and therefore either the plug-in connection device can no longer be used or the plug coding is rendered ineffective.

Furthermore, the expense for the plug coding is relatively high, because various forms of the latching devices in the state of the art are employed to implement different plug codings.

SUMMARY OF THE INVENTION

With regard to the previously described state of the art, the object of the invention is to improve a plug-in connection device of the type mentioned in the introduction such that a reliable plug coding is possible in an economical manner, with little constructional effort, without additional parts and without movable parts, in particular relative to the plug part or socket part.

This object is solved in conjunction with the features of the generic term of Claim 1 such that the respective insert, i.e. plug insert or socket insert, contains electrical connecting devices which are rotationally fixed relative to it and can be inserted into it rotationally fixed in a number of rotated positions relative to the respective assigned part.

Consequently, the plug coding occurs due to the relative orientation of the connecting devices in the respective insert to the plug part or socket part. No additional latching devices, such as with the state of the art, are necessary, which would increase the construction complexity and the costs of such a plug-in connection device. Instead, the plug-in connection device according to the invention is simple and essentially constructed like a normal plug-in connection device without plug coding, whereby the plug coding occurs only through the appropriate arrangement of the plug and socket parts in the corresponding plug or socket housing. Also, a large number of different parts for different codings are not required. Instead, the various codings arise through different rotational orientations.

In this connection it must be noted that it is sufficient if only the plug or socket can be coded appropriately and the respective other part is specified fixed.

According to the invention, there is also the possibility that both the plug and socket parts can be coded, wherein for example the plug insert and the socket insert can be inserted in the respective part in different rotational positions.

The appropriate connecting devices can be arranged in the respective insert depending on the type of connecting device or their quantity. In this connection it should also be considered as advantageous if the electrical connecting devices are held in the insert such that the insert together with the connecting devices can be handled in a simple manner and the assembly of the plug-in connection device is as a whole simplified.

The most varied embodiments of the connecting device are conceivable, which, in particular, may differ with regard to the shape and number of connecting devices. With one embodiment the electrical connecting devices are configured as pins or sockets in appropriate longitudinal holes in the respective insert and protrude, in particular on both sides in the longitudinal direction, over the insert. One protruding end of the connecting device is used for connecting, for example, pins and sockets and the other respective protruding end is used for connecting appropriate electrical connecting leads. The connection of the electrical connecting leads to the connecting devices can occur in the most varied ways, for example by a crimped connection, by insulation piercing connections, by cage-type compression springs or other normal techniques.

It should also be noted that the plug part can be a normal plug or coupling, etc. and the socket part can also be a coupling, wall socket, flanged socket outlet, etc. As already explained, the pole combinability, i.e. the number of connecting devices, is not restricted and any normally used pole combination can be realised according to the invention.

In order to easily and reliably facilitate a range of different codings, the respective insert can exhibit a number of engaging elements which can be brought to engage in various rotational positions with corresponding counter engaging elements in the interior of the associated part. There is, of course, also the possibility that the various rotational positions for the plug coding occur through releasable connection, for example using screws or similar devices, of the insert and associated part. The engaging elements can, for example, be formed as outer elements or as elements arranged on the ends of the respective insert, which engage corresponding counter engaging elements in the interior or at the ends of the plug or socket part. The coding arises through the appropriate relative arrangement of the insert and the part and the assembly of them both, as well as the rotationally fixed relative orientation due to the engagement of engaging elements and counter engaging elements. Put more simply, it can be said in this respect that, due to the relative arrangement of, for example, two fixed points, one on the insert and one on the associated part, various relative rotational positions of the insert and part are possible which determine the plug coding.

In order to be able to determine the appropriate rotational orientation within the corresponding part in a simple manner, the counter engaging elements can be arranged on an essentially sleeve-shaped positioning element in the interior of the respective part, in particular in a predetermined insertion position. That is, the appropriate rotational position of the insert is given by the relative alignment to the sleeve-shaped positioning element and the engagement of engaging elements on the insert and counter engaging elements on the positioning element. The positioning element as such can only be inserted in a predetermined insertion position in the interior of the plug part or socket part. There is, of course, also the possibility that in addition the positioning element can be inserted in various insertion positions relative to the respective part, so that the relative positioning of the insert to the positioning element and of the positioning element to the part as a whole produces the plug coding. Here, appropriate engaging and counter engaging elements can be provided on the positioning element or plug/socket part. With one simple embodiment according to the invention it is conceivable that the positioning element is, in particular detachably, pushed on the insert. Here, the engagement of the engaging and counter engaging elements can occur in the pushed-on state.

In order to be able to define the plug coding in a simple manner at a relative later point in time during assembly, the engaging and counter engaging elements can be formed on mutually assigned ends of the insert and positioning element. That is, the engagement of the engaging and counter engaging elements, and therefore the positioning of the insert in the coding rotational position, only occurs with the positioning element essentially fully pushed onto the insert.

It should again be pointed out that the coding can also occur additionally via the insertion position of the positioning element in the corresponding part.

With one simple embodiment the engaging and counter engaging elements can be formed as grooves and protrusions arranged in the circumferential direction of the insert and positioning element and essentially shaped complementary to one another. The appropriate rotational orientation of the insert relative to the positioning element is in this connection facilitated by the engagement of the grooves and protrusions. There is the possibility that the grooves and protrusions are in each case arranged on both parts, i.e. on the insert and positioning element or the grooves and protrusions are only in each case arranged on one of these parts.

In a further embodiment there is the possibility that the engaging elements are formed in an essentially annular end flange. In this case the appropriate engaging elements can point in the direction of the positioning element, which for example exhibits corresponding counter engaging elements at one end, so that the engagement of the engaging and counter engaging elements occurs essentially as with a spur gear.

Of course, there is also the possibility that the counter engaging elements are arranged not directly at the end of the positioning element, but rather in the end section on an outer or inner side of the positioning element.

In this respect it can be furthermore regarded as advantageous if the end flange exhibits an annular groove which is open in the direction of the positioning element, wherein the engaging elements are arranged at least along an edge of the annular groove. The positioning element can at least be partially inserted by its end into this annular groove and the engagement of the engaging and counter engaging elements occurs in the inserted position.

It should be noted that, of course, the number of engaging and counter engaging elements does not have to be the same. If, for example, the engaging elements are distributed with a certain number along the circumference of the corresponding insert, then an arrangement of, for example, two spaced counter engaging elements on the positioning element is sufficient in order to define appropriate relative rotational orientations of both parts. However, in order to be able to define the relative rotational orientation with little play and reliably, equal numbers of engaging and counter engaging elements can be arranged at the same distance in the circumferential direction.

In order to be able to form an easily to be handled unit of the insertion and positioning elements, the positioning element can be detachably connected to the insert in particularly the corresponding relative or rotational orientation. In this way the insert can be inserted together with the positioning element in the plug or socket part.

The detachable connection can occur in the most different ways, such as for example through a detachable screwed joint or similar technique. In one simple embodiment the positioning element and the insert can be latched together in the corresponding relative rotational orientation.

To produce the locking connection, a locking dog, which engages a corresponding locking opening depending on the relative rotational orientation of the insert and positioning element, can for example protrude in the interior of the positioning element.

In order to be able to introduce the insert and positioning element in a simple manner into the appropriate housing of the plug or socket, the positioning element can in particular be inserted rotationally fixed at least partially into an accommodating sleeve of the plug or socket insert in a predetermined insertion position. The accommodating sleeve is itself arranged rotationally fixed within a threaded sleeve.

For realising the rotationally fixed arrangement, guides can be formed between the accommodating sleeve and the threaded sleeve, in particular extending in the longitudinal direction of the threaded sleeve. These guides are used on one hand for inserting the accommodating sleeve into the threaded sleeve and on the other hand they prevent rotation of the two parts relative to one another.

At one end the threaded sleeve generally exhibits an appropriate external thread with which it can be inserted into a plug or socket housing.

In order to keep appropriate electrical connecting leads ready constructively simply for connection to the connecting devices and to be able to insert them into the plug or socket part, a rotating sleeve, in the internal hole of which electrical leads connected to the electrical connecting devices are arranged in a sealed manner, can be inserted, in particular rotationally, in the end of the threaded housing facing away from the positioning element. The insertion and sealing of the electrical leads in the rotating sleeve can occur during assembly or during insertion of the rotating sleeve into the threaded sleeve, whereby, previously or also following, an appropriate connection between the connecting device and the electrical leads can be established.

With appropriate rotational capability of the rotating sleeve relative to the threaded sleeve it is also ensured that the electrical leads can adjust strain-free after assembly and connection to the connecting devices.

Easily implemented and well functioning sealing, particularly compression-proof, can be achieved for example in that a potting material, which hardens after application, is introduced into the internal hole for the sealing of the electrical leads.

So that as little oxygen as possible is present between the rotating sleeve and the threaded sleeve and, in particular in areas subject to the risk of explosion, so that a flame cannot penetrate, a flameproof gap can be formed between the outer side of the rotating sleeve and the inner side of the threaded sleeve at least to ex-d type of protection. In this way the plug-in connection device according to the invention can also be used in areas subject to explosion hazards. The aforementioned gap is also sufficiently long to ensure sufficiently high thermal dissipation within the material. Consequently, on one hand a rotating capability of the electrical leads relative to the connecting devices is facilitated through the rotating sleeve and the threaded sleeve and on the other hand flame penetration is prevented.

To extend the gap, as well as for simplified handling and for simplified insertion of the rotating sleeve in the threaded sleeve, the rotating sleeve can exhibit a locating flange protruding outwards at its insertion end. With the rotating sleeve inserted, this flange contacts one end of the threaded sleeve. Consequently, the gap between the outer side of the rotating sleeve and the inner side of the threaded sleeve in the region of the locating flange and the end of the threaded sleeve is extended. Furthermore, the locating flange defines the insertion position of the rotating sleeve.

In order to also improve the configuration between the rotating sleeve and the insert, the rotating sleeve can at its inner end remote from the insertion end be in contact with the end flange of the insert.

To extend the gap further and also for the sealing of the plug-in connection device, the end flange can exhibit an insertion groove facing the inner side, running at least partially around the circumference. The inner end of the rotating sleeve can be inserted into this groove.

The positioning element can for example be arranged rotationally fixed in the interior of the housing of the plug or socket in the appropriate insertion position. A simplification of the plug-in connection device according to the invention can consequently be achieved in that the positioning element is arranged rotationally fixed in the threaded sleeve and is also optionally fixed in the longitudinal direction. Here, the fixing can occur in a manner such that later modification of the coding by a user is more difficult or even prevented entirely.

One example of such a fixing in the longitudinal direction is the securing of the positioning element in its predetermined rotational position via the accommodating sleeve, in particular by a retaining ring. This is inserted from a side of the plug-in connection device facing away from the rotating sleeve and engages a corresponding groove in the inner side of the threaded sleeve, whereby it protrudes so far from this groove that the accommodating sleeve contacts the retaining ring. The end of the accommodating sleeve opposite the retaining ring can here contact an optionally annular circumferential protrusion in the interior of the threaded sleeve.

In order to detachably connect the plug part and the socket part in a simple manner, a union sleeve can be rotationally mounted on the threaded sleeve at one of its ends. This means that after insertion of the plug part into the socket part an appropriate attachment of both parts is achieved by rotating the union sleeve, so that they are held together detachably in their connecting position.

It has already been pointed out that the threaded sleeve can be screwed into a plug housing with an appropriate thread. Of course, an appropriate attachment of the threaded sleeve in the plug housing can be achieved in other ways, such as for example by a screwed joint or similar technique.

The construction of the appropriate part and in particular of the socket part can be simplified if the positioning element is formed as a socket insert. This can for example be attached directly to a corresponding socket housing by screwing or similar technique. To this end, the socket insert can exhibit on its outer side particularly groove shaped connecting elements for attachment within the socket housing.

In order to design the plug-in connection device according to the invention resistant to impacts and secure against flame penetration, at least the inserts and the corresponding sleeves can be produced from an impact resistant and penetration-proof material, in particular a plastic material. Examples of such plastic material are polyamide, glass-fibre reinforced polyester or similar materials.

DETAILED DESCRIPTION OF THE INVENTION

Figure 1:
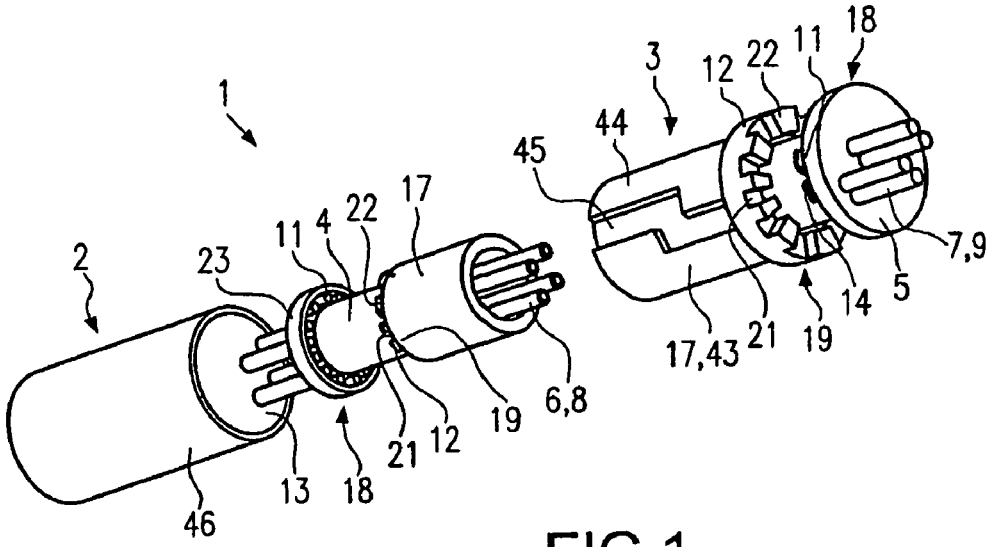
FIG. 1 a perspective side view of an embodiment of a plug-in connection device according to the invention consisting of plug part and socket part.

FIG. 1 shows a perspective side view of a plug-in connection device 1 pulled apart, with plug part 2 and socket part 3. The plug part 2 is illustrated with all its details in FIG. 2, whereas some details have been omitted in the illustration of FIG. 1 for the sake of simplicity. The plug part 2 can be inserted into a plug housing which is not illustrated and correspondingly socket part 3 can be inserted into a socket housing which is also not shown.

The plug part 2 exhibits in the interior 13 a plug insert 4 and this has an approximately cylindrical shape with an end flange 23, arranged at one end 18 and protruding radially outwards. A connecting device 6 consisting of four connector pins 8 is arranged in a suitable longitudinal hole 10, see also FIG. 4. The connector pins 8 protrude over the plug insert 4 at both sides.

Analogously a socket insert 5 in the interior 14 of the socket part 3 also exhibits an end flange 23 at one end 18 and connector sockets 9 are configured in suitable longitudinal holes 10 as a connecting device 7. The connector pins 8 and connector sockets 9 are arranged in an appropriate number and configuration such that, with the plug part 2 and the socket part 3 joined together, they engage to establish an electrical connection.

Figure 4:
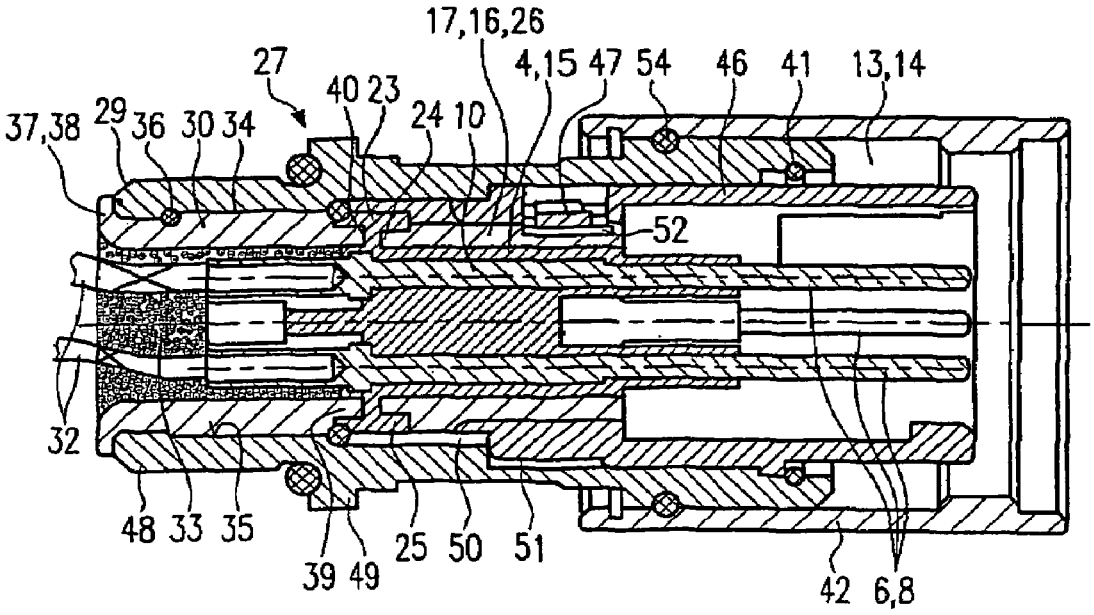
FIG. 4 a longitudinal section through an assembled plug part according to FIG. 2.

The plug insert 4 exhibits an annular groove 24 at its end 18 in the end flange 23, see also FIG. 4. This is open in the direction of a positioning element 17 which can be pushed onto the plug insert 4. The positioning element 17 is formed shaped as a sleeve and exhibits as counter engaging elements 12 a series of grooves 21 and protrusions 22 at its end 19 facing the end 18 of the plug insert 4. With the positioning element 17 completely pushed on the plug insert 4, they engage engaging elements 11 protruding radially inwards from an edge 25 of the annular groove 24. The engaging elements 11 are similarly formed by a series of protrusions 22 with the grooves 21 arranged in between.

Analogously, a suitable positioning element 17 is formed as a socket insert 43 at its end 19, whereby similarly engaging elements 11 are analogously provided at the corresponding end 18 of the socket insert 5.

In the illustrated embodiment there are twelve grooves 21 or twelve protrusions 22 arranged at the end 18 or the end 19 of the insert 4, 5 or positioning element 17. Accordingly, there are 12 different rotational positions 15 of the insert 4, 5 relative to the positioning element 17.

The socket insert 43 can be inserted rotationally fixed in a socket housing which is not illustrated, so that the corresponding relative rotational position 15 of the socket insert 5 relative to the connector socket insert 43 also with regard to the socket housing, which is not shown, is established. The definition of a suitable insertion position 16 of the socket insert 43 in the socket housing occurs through connecting elements 45 arranged in the outer side 44 of the socket insert 43. In the illustrated embodiment they are formed groove-shaped.

The positioning element 17 of the plug part 2 can be inserted in an accommodating sleeve 46 in a specified insertion position 16, see FIG. 4. The rotationally fixed arrangement in this insertion position 16 occurs by the latching of the positioning element 17 within the accommodating sleeve 46, refer to FIG. 3 with regard to the latching dog 47.

Figure 2:
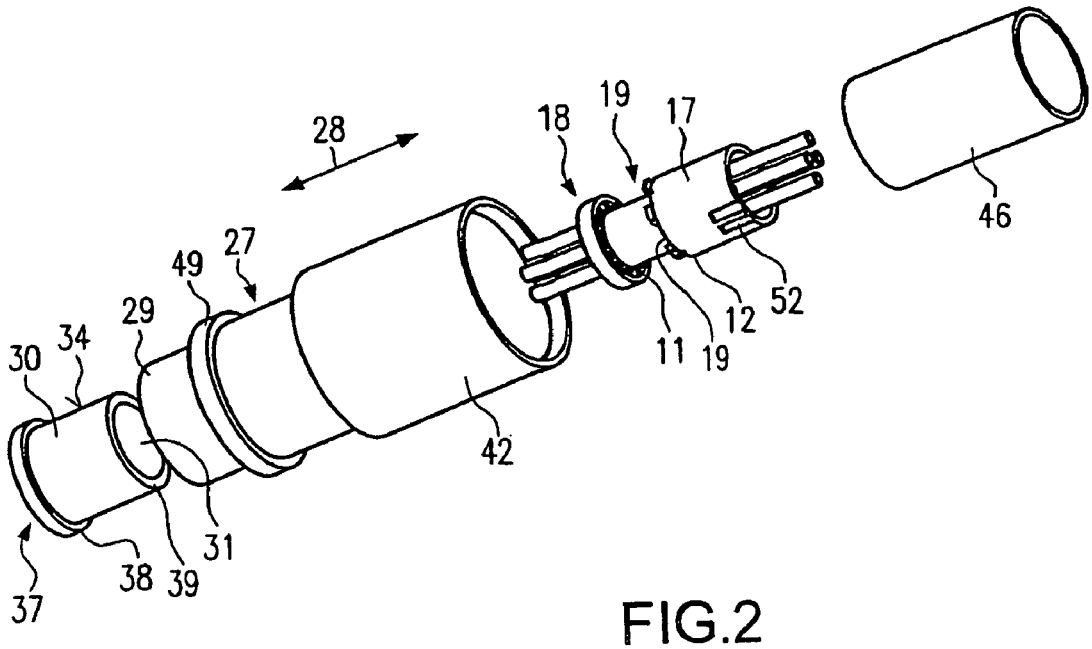
FIG. 2 an enlarged illustration of the plug part according to FIG. 1.

The accommodating sleeve 46 can be inserted into a threaded sleeve 27, see FIGS. 2 and 4, and is fixed in it in a certain rotational position such that the insertion position 16 of the positioning element 17 is also determined relative to the threaded sleeve 27 by a corresponding relative position 26, see FIG. 4.

The rotationally fixed arrangement of the accommodating sleeve 46 within the threaded sleeve 27 occurs via appropriate guides between the two sleeves.

FIG. 2 shows a plug part 2 according to FIG. 1 additionally with the threaded sleeve 27 and the rotaling sleeve 30. The threaded sleeve 27 exhibits an annular circumferential locating flange 49, which is used for the definition of a screw-in position of the threaded sleeve 27 in a plug housing which is not shown. The rotating sleeve 30 can be inserted in it from the end 29 facing away from the accommodating sleeve 46, refer also to FIG. 4 in this respect. The rotating sleeve 30 exhibits an internal hole 31. Electrical leads 32 can be arranged in this hole, see FIG. 4, which can be connected to the connector pins 8 as the connecting devices 6 of the plug part 2 in a known manner. The connection can for example occur using a crimped connection, insulation piercing connections or cage-type compression springs.

In the internal hole 31 the electrical leads 32 are arranged sealed by a suitable potting material 33, refer to FIG. 4 in this respect.

On its insertion end 37 facing away from the plug insert 4, the rotating sleeve 30 exhibits a locating flange 38 protruding radially outwards. This flange contacts the free end 29 of the threaded sleeve 27 in the inserted position of the rotating sleeve 30, see FIG. 4. A gap 36 is formed between the outer side 34 of the rotating sleeve 30 and the inner side 35 of the threaded sleeve 27. The said gap exhibits a narrow gap dimension so that as little oxygen as possible is contained in the gap. Due to this narrow gap dimension and the corresponding length of the gap in the longitudinal direction 28, see FIG. 2, it is ensured that the plug-in connection device according to the invention is proof against flame penetration and can therefore also be used in areas subject to explosion hazards. Due to the protection against flame penetration and also due to the potting material 33, the plug-in connection device 1 according to the invention is realised with ex-d type of protection.

The rotating sleeve 30 and the gap 36 formed between it and the threaded sleeve 27 facilitate however a rotation of the rotating sleeve 30 so that the electrical leads 32 can adjust strain-free after the assembly of the plug-in connection device 1. In FIG. 2 a union sleeve 42 is also shown, which is pushed onto the threaded sleeve 27 externally and is supported there for rotation, see also FIG. 4. The union sleeve 42 is used to connect the plug part 2 and the socket part 3 when it is electrically connected to the corresponding connecting devices 6, 7 or the connector pins 8 and connector sockets 9.

Figure 3:
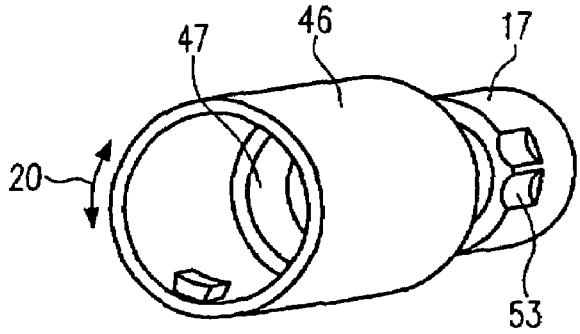
FIG. 3 an enlarged illustration of the positioning element and accommodating sleeve.

The positioning element 17 of the plug part 2 and the accommodating sleeve 46 are illustrated enlarged in FIG. 3.

In particular it can be seen that adjacently arranged locking grooves 53 are provided on an outer side of the positioning element 17 in the circumferential direction 20. The said grooves can engage a corresponding locking dog 47 in the interior of the accommodating sleeve 46 such that the positioning element 17 is held rotationally fixed relative to the accommodating sleeve 46. Through the appropriate rotationally fixed arrangement of the accommodating sleeve 46 relative to, for example, the threaded sleeve 27, refer to FIGS. 2 and 4 in this respect, the positioning element 17 is consequently defined and due to its rotationally fixed engagement with the plug insert 4, the plug coding is also defined by the corresponding rotational position 15 of the plug insert 4.

A longitudinal cross-section of an assembled plug part 2 is illustrated in FIG. 4.

The threaded sleeve 27 exhibits an external thread 48 at one end, with the aid of which the threaded sleeve can be screwed into a plug housing which is not illustrated. The screw-in position is determined by a locating flange ring 49 which runs radially externally around the threaded sleeve 27. The union sleeve 42 is pushed onto the threaded sleeve 27 from the outside. The union sleeve is used for connecting the plug part and the socket part, see also FIG. 1. The union sleeve 42 is sealed relative to the threaded sleeve 27 by a sealing ring 54. The union sleeve 42 can be moved relative to the threaded sleeve 27 in the longitudinal direction 28, see FIG. 2.

Opposite the union sleeve 42 the rotating sleeve 30 is inserted in the end 29 of the threaded sleeve 27. At its insertion end 37 assigned to the end 29 it exhibits a locating flange 38, protruding radially outwards and running circumferentially in an annular shape. The said flange is in contact with the end 29 of the threaded sleeve 27 in the insertion position of the rotating sleeve 30. The gap 36 is formed between the outer side 34 of the rotating sleeve 30 and the inner side 35 of the threaded sleeve 27.

The rotating sleeve 30 is supported rotationally within the threaded sleeve 27 such that the electrical leads 32 can adjust strain-free depending on the assembly of the plug insert 4 in the respective rotational position 15. The electrical leads 32 are sealed within the rotating sleeve 30 by the potting material 33.

The electrical leads 32 are connected to the connection devices 6 in the form of connector pins 8. The connector pins 8 are arranged in appropriate longitudinal holes 10 of the plug insert 4. The plug insert 4 exhibits the circumferential end flange 23 at its end facing the rotating sleeve 30. In this said flange a groove is formed in both longitudinal directions 28, see FIG. 2, whereby the circumferential annular groove 24 is assigned to the positioning element 17 and the insertion groove 40 to the inner end 39 of the rotating sleeve 30.

Along the outer edge 25 of the annular groove 24, the grooves 21 or protrusions 22 protrude as engaging elements 11, see FIG. 1 or 2 in this respect. Corresponding grooves/protrusions 21, 22 engage these grooves/protrusions 21, 22 as counter engaging elements 12 on the end 19 of the positioning element 17. The respective rotational position 15 of the plug insert 4 is defined by the engagement of the engaging elements 11 and the counter engaging elements 12.

The positioning element 17 is completely pushed onto the plug insert 4 and can be locked in its corresponding insertion position 16 with the plug insert 4.

Furthermore, the positioning element 17 exhibits at least one locking indentation 52 on its outer side, see also FIG. 3, which engages a corresponding locking dog 47, which protrudes in the interior of the accommodating sleeve 46. Due to this engagement of the locking indentations 52 and locking dog 47, a certain relative position of the positioning element 17 relative to the accommodating sleeve 46 and therefore to the threaded sleeve 27 is defined.

The accommodating sleeve 46 extends in the longitudinal direction 28 up to approximately the ends of the connector pins 8 so that they are essentially arranged in the interior of the accommodating sleeve 46. On its outer side, the accommodating sleeve 46 exhibits a flange which runs essentially in a circumferentially annular shape and which protrudes radially outwards and separates a section 50 with a smaller diameter from a section 51 of the accommodating sleeve with a larger diameter. With the accommodating sleeve 46 inserted in the threaded sleeve 27, it contacts an appropriate step-shaped protrusion on the inner side 35 of the threaded sleeve 27. This contacting position is ensured by a retaining ring 41, which partially engages a circumferential annular groove on the inner side 35 of the threaded sleeve 27. The union sleeve 42 is located on the outside of the threaded sleeve 27, where it is rotationally supported. A sealing ring 54 is provided for the sealing between the threaded sleeve 27 and the union sleeve 42. The connection of the plug part 2 and the socket part 3 occurs via the union sleeve 42, see FIG. 1. For this, the socket insert 43, which serves as the positioning element 17 for the socket part 3, exhibits suitable connecting elements 45, which for example can be formed in the shape of a groove. These connecting elements 45 are arranged in the outer side 44 of the socket insert 43.

In the following the functional principle of the plug-in connection device 1 according to the invention is explained briefly based on the figures.

The rotating sleeve 30, see FIGS. 2 and 4, is used for holding the electrical leads 32 in a sealed manner. The rotating sleeve is inserted rotationally in the threaded sleeve 27, whereby a relatively narrow gap 36 is formed between them both, which contains as little oxygen as possible and which exhibits a sufficient length so that if a possible flame or arc arises in the region of the connecting devices 6, 7, a flame is prevented from penetrating the gap 36. In addition, the appropriate length of the gap 36 provides relatively good thermal dissipation within the material, which is preferably formed from an impact-resistant material which is also safe against flame penetration, such as for example, polyamide, glass-fibre reinforced polyester or a similar material.

With the plug-in connection device 1 according to the invention, the plug coding is achieved in that the plug insert 4 and analogously also the socket insert 5, see FIG. 1, are arranged in a series of rotational positions 15 relative to the positioning element 17. For example, with an arrangement of twelve grooves 21/protrusions 22 a total of twelve different angular settings are possible as rotational positions 15, so that due to these different rotational settings 15, twelve different types of connection can be assigned to the plug-in connection device 1 and consequently a corresponding plug coding is obtained. Subsequent modification of the coding by a user is rendered more difficult or prevented in that during the assembly of the plug-in connection device 1, a retaining ring 41 is used which, normally, can no longer be pulled off and which secures the positioning of the accommodating sleeve 46 relative to the threaded sleeve 27. Within this accommodating sleeve 46 the positioning element 17 and the plug insert 4 are arranged rotationally fixed in the appropriate relative position 26 or rotational position 15.

The invention claimed is:

1. A plug-in connection device comprising:

a first part including a first insert and a positioning element; and a second part including a second insert, the second part being detachably connectable to the first part, wherein:

the first part and the first insert are one of either a plug part and a plug insert or a socket part and a socket insert, and the second part and the second insert are the other of the plug part and the plug insert or the socket part and the socket insert, the first insert is configured for plug coding and includes electrical connection devices that cannot be rotated relative to the first insert, and can be inserted into the first part so as to be rotationally fixed in one of a number of rotational positions relative to the first part, engaging and counter engaging elements that can engage in various rotational positions are formed at mutually assigned ends of the first insert and of the positioning element, and the positioning element is insertable in the interior of the first part in a predetermined insertion position.

2. The plug-in connection device of claim 1, wherein the second insert can be inserted into the second part in different rotational positions.

3. The plug-in connection device of claim 1, wherein the first and second inserts retain electrical connecting devices.

4. The plug-in connection device of claim 3, wherein the electrical connecting devices are arranged as connector pins or connector sockets in appropriate longitudinal holes in the first and second inserts.

5. The plug-in connection device of claim 1, wherein the first insert exhibits a number of engaging elements that can be brought into engagement with corresponding counter engaging elements in an interior of the first part in the different rotational positions.

6. The plug-in connection device of claim 5, wherein the positioning element is sleeve-shaped and the counter engaging elements are arranged on the sleeve-shaped positioning element.

7. The plug-in connection device of claim 1, wherein the positioning element is detachable from the first insert.

8. The plug-in connection device of claim 1, wherein the engaging and counter engaging elements are formed as grooves and protrusions that are complementary to one another and are arranged in a circumferential direction of the first insert and the positioning element.

9. The plug-in connection device of claim 1, wherein the engaging elements are formed on an annular, circumferential end flange of the first insert.

10. The plug-in connection device of claim 9, wherein the end flange exhibits an annular groove that is open in the direction of the positioning element, and the engaging elements are arranged at least along one edge of the annular groove.

11. The plug-in connection device of claim 1, wherein the positioning element is detachably connected to the first insert in a particular position relative to the first insert.

12. The plug-in connection device of claim 11, wherein the positioning element and the first insert lock into one another in the particular position.

13. The plug-in connection device of claim 1, wherein the positioning element is at least partially inserted in a predetermined insertion position in an accommodating sleeve of the first part.

14. The plug-in connection device of claim 13, wherein guides are formed between the accommodating sleeve and an outer threaded sleeve of the first part, with the guides extending in a longitudinal direction of the threaded sleeve.

15. The plug-in connection device of claim 14, wherein a rotating sleeve is inserted in an end of the threaded sleeve facing away from the positioning element, and electrical leads are arranged and sealed in an internal hole of the rotating sleeve.

16. The plug-in connection device of claim 15, wherein a potting material is introduced into the internal hole for compression-proof sealing of the electrical leads.

17. The plug-in connection device of claim 15, wherein the rotating sleeve includes an outwardly-protruding locating flange at an end that is inserted into the threaded sleeve.

18. The plug-in connection device of claim 17, wherein the rotating sleeve is in contact with an end flange of the first insert at an end opposite the end that is inserted into the threaded sleeve.

19. The plug-in connection device of claim 14, wherein a union sleeve is rotably connected to one end of the threaded sleeve.

20. The plug-in connection device of claim 19, wherein the first part and the second part, when connected, are detachably held together by the union sleeve.

* * * * *